United States Patent [19]

Brandner

[11] 4,305,598

[45] Dec. 15, 1981

[54] SPEED SKATE PLATE

[76] Inventor: Ernest E. Brandner, 2301 S. Laramie, Cicero, Ill. 60650

[21] Appl. No.: 22,084

[22] Filed: Mar. 19, 1979

[51] Int. Cl.[3] ..... A63C 17/02

[52] U.S. Cl. ..... 280/11.2; 280/11.28

[58] Field of Search ..... 280/11.19, 11.2, 11.27, 280/11.28; 85/1 P; 411/386

[56] References Cited

U.S. PATENT DOCUMENTS

| | | | |
|---|---|---|---|
| 2,829,696 | 4/1958 | Wagner | 411/386 |
| 3,035,846 | 5/1962 | Asad | 280/11.2 |
| 3,156,482 | 11/1964 | Ware | 280/11.2 |
| 3,738,673 | 6/1973 | Iseman | 280/11.28 |

FOREIGN PATENT DOCUMENTS

| | | | |
|---|---|---|---|
| 2824491 | 3/1978 | Fed. Rep. of Germany | 85/1 P |
| 1505530 | 11/1967 | France | 411/386 |
| 646701 | 10/1962 | Italy | 411/386 |
| 1204853 | 9/1970 | United Kingdom | 411/386 |

*Primary Examiner*—John J. Love

*Assistant Examiner*—Michael Mar

*Attorney, Agent, or Firm*—Silverman, Cass & Singer, Ltd.

[57] ABSTRACT

A speed skate plate having an elongate plastic member with means for securing a shoe on the top of the member and having axle anchors at the bottom of the plate, at the front and rear ends thereof. Each anchor is secured to the plate by means of a resilient connection permitting limited rocking of the anchor and has a pivot spur with a ball on the end thereof engaged in a socket formed in the plate. At the front of the plate a clamp is provided which is formed partially by the plate and partially by an additional plastic member that is tightly secured to the side of the front of the plate. A through threaded passageway in the clamp carries the stud of an elastomeric nose piece. The socket for the ball of the spur of the front anchor is deeper than the prior art and that portion of the plate is strengthened by side gussets. The nose piece stud has a pilot to prevent cross threading of the stud during installation.

14 Claims, 3 Drawing Figures

SPEED SKATE PLATE

FIELD AND BACKGROUND OF THE INVENTION

The field of the invention comprises roller skates and more particularly is concerned with the plate of a roller skate designed for speed skating.

High speed skating on roller skates requires equipment which must withstand great shock. Known speed roller skates comprise an elongate plate normally cut from synthetic resins such as nylon, Delrin and similar polymers. A typical roller skate uses a plate which is about one and one fourth inches deep, about three fourths of an inch thick and has a length which depends upon the size of the shoe that is attached to the upper edge. The wheels of the roller skate are connected to axles that are provided in anchors. The anchors are castings of aluminum or other metal mounted in notches provided in the front and rear of the skate. Each anchor has a resilient mounting which connects to the skate and also has a spur with a ball that engages a socket in its notch.

At the front end of the skate there is a clamp formed by bolting an additional member to the side of the plate, a threaded passageway being drilled through the joint. An elastomeric nose piece which is molded to a threaded stud is engaged in the threaded passageway and held in place by the clamp.

The weakest portion of the plate is at the front notch. The skater starts skating by running several steps on the toe piece before jumping onto the wheels. The plate will break through at the notch. Additionally, since there is some resilience in the plate itself, if a particularly heavy skater or even a normal skater applies particular pressure on the front end of the skate the plate will bend, the ball of the spur will jump out of its socket and not return following which the offset anchor places extreme lateral stress on the front end of the plate and can break it through.

The invention strengthens the front end of the plate by closing the sides of a portion of the notch in the vicinity of the socket. This unexpectedly deepens the socket and thereby prevents the spur from jumping out of the socket.

The nose piece of known skates is screwed into the threaded passageway. Since the plastic is fairly soft, problems arise with cross threading which can thereby jam the stud. A pilot projection is formed on the end of the stud in accordance with the invention either integrally with the stud or added to the stud thereby making it practically impossible to cross thread the stud. In doing this it turns out that the stud can now be lengthened and thereby will enable the skates to be constructed with larger wheels because the stud can be screwed out of the threaded passageway almost its full extent without the danger of having it break out of the passageway. The pilot provides a firm engagement with the greater portion of the passageway.

SUMMARY OF THE INVENTION

A plate for a speed skate which includes an elongate plastic member having a rectangular cross section and being arranged with the longer side of the rectangle vertically. Means are provided for securing a shoe to the upper edge of the plate and the bottom has a notch adjacent the front end and adjacent the rear end thereof. Axle anchors are mounted to the plate in each of the notches, each axle anchor being secured to the plate by means of a resilient mounting and having an integral spur with a ball end engaging a socket formed in the corner of the notch.

The front notch has an integral gusset closing off a portion of the notch and providing a fairly deep socket so that the spur of the front axle anchor will not readily jump out of the socket during use of the skate and also strengthening the neck across that portion of the plate.

The front end of the plate is provided with an additional member bolted to the side thereof to provide a clamping arrangement, there being a threaded passageway through the clamp portion. A toe piece of elastomeric material is molded to a threaded stud which is secured in the passageway. The stud is provided with a pilot extension whose diameter is closely equal to the root diameter of the thread of the stud.

DESCRIPTION OF THE PREFERRED EMBODIMENT

Figure 1:
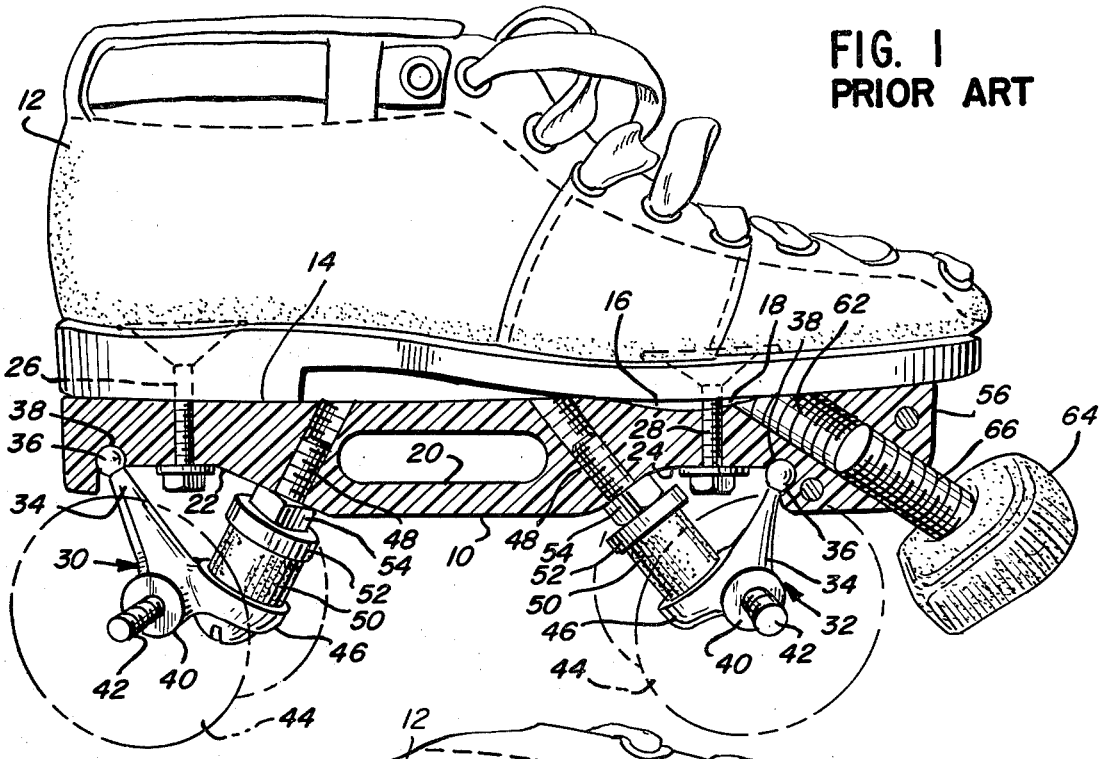
FIG. 1 PRIOR ART
FIG. 1 is a median sectional view with portions shown in elevation of a speed roller skate illustrating the prior art.

In FIG. 1 there is illustrated a roller skate especially for use in speed skating. The roller skate is based upon a so-called plate 10 which is an elongate member of a synthetic resin which has great strength. Preferably the plate is formed of sheet nylon, Delrin or the like which has been machined from sheet or block material. The invention does not exclude molding although it is most usual to machine such plates inasmuch as there are a great many sizes depending upon the size of the shoe 12 which is secured thereto.

The plate 10 is normally of rectangular cross section with the longer dimension of the rectangle vertical. A typical plate will be made out of three fourth inch plastic and have a depth top to bottom of about one and one fourth inches. The upper edge 14 of the plate is flat and may have a shallow notch 16 at the front end thereof to accommodate a circular disc 18 which assists in spreading the pressure at the front end of the shoe. The plate has a cut-out 20 to save weight. There is a rear notch 22 and a front notch 24 cut from the bottom edge of the plate 10. A pair of bolts 26 and 28 having enlarged upper ends anchor the shoe 12 in place, suitable nuts are secured to the bottom ends of the bolts 26 and 28 which are accessible in the notches 22 and 24 respectively.

Each of the notches 22 and 24 has an axle anchor of known construction there being a rear anchor 30 and a front anchor 32. These anchors are of unitary construction and are cast of aluminum or steel and each includes a spur at 34 having a ball 36 at the end thereof which engages in a suitable socket 38 formed in the respective front and rear ends of the plate 10. There is a central tubular portion 40 from which stub axles protrude laterally, these stub axles 42 being arranged to have wheels 44 mounted thereon.

Each anchor includes a seat 46 through which a large bolt or screw 48 engages. A rubber bushing 50 is mounted on the bolt 48 one end against the seat 46. A washer seat 52 is clamped against the other end of the bushing 50 by a locking nut 54 adjacent the plate.

At the front end of the plate 10 there is an enlarged portion 56 which has an additional plastic member 58 (see FIG. 3) clamped thereto by means of the screw 60. A threaded passageway 62 extends fully through these two members. A rubber nose piece 64 is molded to a threaded stud 66 which is engaged in the passageway 62.

In use the skater runs a few steps on the nose piece 64 and then jumps back onto wheels 44 and commences stroking. Breaks occur in the vicinity of the notch 24 because of the great strain placed on that part of the skate during the running activity and very often because the ball 36 jumps out of its socket 38 in the front notch 24 and when unable to return places a great lateral strain on the plate 10.

Figure 2:
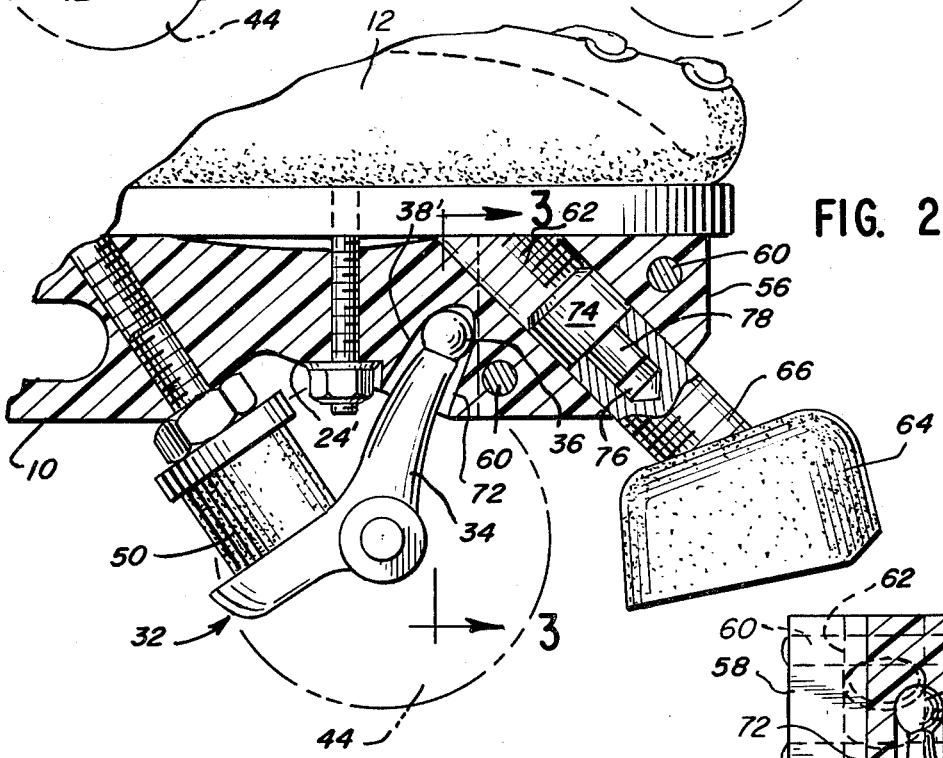
FIG. 2 is an enlarged view similar to that of FIG. 1 but showing the front end of a speed skate in which the plate and nose piece are constructed in accordance with the invention.
Figure 3:
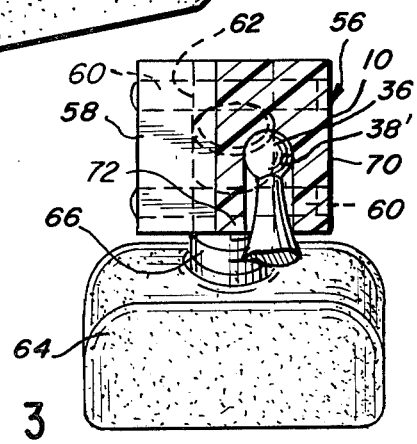
FIG. 3 is a fragmentary sectional view taken generally through the plate of FIG. 2 and in the indicated direction.

The invention is illustrated in FIGS. 2 and 3 in which the same characters of reference are used as used in FIG. 1, so far as possible. In FIG. 2, the front portion of the roller skate is shown and in this case the notch 24 of FIG. 1 has been changed and will be referred to as the notch 24'. The anchor 32 is identical in all respects to the anchor 32 of FIG. 1. The socket 38 is now referred to as the socket 38' and it will be seen that this socket 38' is now substantially deeper due to the presence of a pair of side gussets 70 and 72 which close off a portion of the notch 24'. This structure very substantially strengthens the plate 10 right across the neck above the notch 24' while at the same time producing a deep socket 38' from which the spur 34 cannot escape. The notch 24' has a substantially triangular configuration with a bolt 48 in the rear side and the gussets 70 and 72 in the front side of the triangular configuration.

It should be understood that in skating the rubber bushing 50 provides resilience to enable lateral rocking of the wheels 44 pivoting around the ball 36.

As previously stated the toe piece 64 is a rubber or other elastomeric member molded onto a threaded stud 66 which is engaged in the passageway 62 of the clamp 56. The invention provides an extension 74 which is secured to the end of the stud 66 to pilot the stud into the passageway 62 and thereby prevent cross threading. This extension 74 may be integral with the stud 66 when the stud is formed, its diameter being equal to the root of the thread of the stud 66.

Present studs may be modified to provide them with the pilot extension 74 by drilling a passageway 76 in the center of the stud and by separately forming the extension 74 with a reduced diameter portion 78 having a driving fit with the passageway 76. In addition to providing for elimination of the possibility of cross threading, the extension 74 enables the stud 66 to be screwed out of the passageway 62 a substantial distance, as for example, when required by using larger wheels 44 than normal. With only a small portion of the thread of the stud 66 being engaged, there is still the extension 74 firmly engaged in the passageway 62 to provide a strong leverage preventing the stud 66 from breaking out of the threaded passageway 62.

Variations are capable of being made without departing from the spirit or scope of the invention as defined in the appended claims.

What it is desired to secure by Letters Patent of the United States is:

1. A mounting for a roller skate especially for speed use, said mounting including an elongate plastic plate having a generally rectangular cross section, a pair of notches adjacent the front and rear ends of the plate facing downwardly, means in the notches for enabling the securement of a shoe to the top edge of the plate, an axle anchor in each notch, each axle anchor having a resilient securement with the plate to provide for limited lateral movement of the axle anchor and each anchor including a spur having a ball on the end thereof, each ball being engaged in a respective socket formed in said plate, at least the front notch having side gussets downwardly depending from said plate closing off a portion of the notch and to provide a socket containing a portion of said spur and substantially deeper than that of the rear notch to prevent accidental withdrawal of the spur from said socket in the front notch, and a toe piece secured to the front end of the plate.

2. A skate mounting as claimed in claim 1 in which said front notch is generally triangular, the means securing the front axle anchor to the plate being engaged in one arm of the triangle and the gussets forming the other arm of the triangle and having the socket formed between the gussets.

3. The mounting as claimed in claim 1 further including a clamp in the front end of the plate having a through threaded passageway therein, and an elastomeric toe piece having a threaded stud connected thereto, the threaded stud being engaged in said passageway.

4. The skate mounting as claimed in claim 3 in which the threaded stud has a root diameter and there is an unthreaded extension on the end thereof which is substantially the same in diameter as the root diameter of the thread of said stud, the extension forming a passageway pilot for the stud and wherein said extension engages said passageway to provide leverage preventing said stud from breaking out of said passageway.

5. The mounting as claimed in claim 4 in which said unthreaded extension is formed separately from the stud and engaged to the end of the stud opposite the elastomeric toe piece.

6. A mounting for a roller skate especially for speed use, said mounting including an elongate plastic plate having a generally rectangular cross section, a pair of notches adjacent the front and rear ends of the plate facing downwardly, means in the notches for enabling the securement of a shoe to the top edge of the plate, an axle anchor in each notch, each axle anchor having a resilient securement with the plate to provide for limited lateral movement of the axle anchor and each anchor including a spur having a ball on the end thereof, each ball [and a portion of said spur] being engaged in a respective socket formed in said plate, a clamp in the front end of the plate having a through threaded passageway therein arranged at an oblique angle relative to the normal horizontal plane of the skate, an elastomeric toe piece having a threaded stud connected thereto, the threaded stud being engaged in said passageway and said stud having an unthreaded extension on the inner end thereof which extension has a diameter substantially the same as the root diameter of the stud thread so as to serve as a passageway pilot for the stud and wherein said extension engages said passageway to provide leverage preventing said stud from breaking out of said passageway.

7. A skate mounting as claimed in claim 6 in which said unthreaded extension is formed separately from the stud and engaged to the end of the stud opposite the elastomeric toe piece, such that said stud includes a central passageway into which a portion of said extension is positioned in driven fit.

8. A skate mounting as claimed in claim 6 wherein said extension is an integral formation on the end of said stud.

9. A mounting for a roller skate, especially for speed use, comprising:

(1) a generally elongate plate member for securement of a shoe to the top edge thereof, said plate having a through threaded passageway therein, generally positioned at one end of said plate member; and (2) an elastomeric toe piece having a threaded stud connected thereto, for removable engagement of said threaded stud in said passageway; and (3) an unthreaded extension on the other end of said stud, which extension has a diameter substantially the same as the root diameter of said stud thread so as to serve as a passageway pilot for the stud and wherein said extension engages said passageway to provide leverage preventing said stud from breaking out of said passageway.

10. A skate mounting as claimed in claim 9 wherein said unthreaded extension is formed separately from said stud such that a portion of said extension is fitted into a central passageway formed in said stud.

11. The skate mounting as claimed in claim 9 wherein said extension is integrally formed on said stud.

12. A toe piece assembly for adjustable projection from a roller skate, comprising:

(1) an elastomeric toe piece connected at one end of a threaded stud; and (2) an unthreaded extension on the other end of said stud, which extension has a diameter substantially the same as the root diameter of said stud thread.

13. The toe piece assembly as claimed in claim 12 wherein said stud includes a central passageway into which a portion of said extension is fitted.

14. The toe piece assembly as claimed in claim 12 wherein said extension is integrally formed on said stud.

* * * * *

UNITED STATES PATENT AND TRADEMARK OFFICE

CERTIFICATE OF CORRECTION

PATENT NO. : 4,305,598

DATED : December 15, 1981

INVENTOR(S) : Ernest E. Brandner

It is certified that error appears in the above-identified patent and that said Letters Patent are hereby corrected as shown below:

Column 4, line 53 delete "[and a portion of said spur]".

Signed and Sealed this

*Sixteenth* Day of *March 1982*

[SEAL]

*Attest:*

GERALD J. MOSSINGHOFF

*Attesting Officer*

*Commissioner of Patents and Trademarks*